United States Patent [19]

Cook

[11] Patent Number: 4,925,358

[45] Date of Patent: May 15, 1990

[54] TRAILERABLE EARTH DIGGING APPARATUS

[75] Inventor: Paul J. Cook, New Berlin, Wis.

[73] Assignee: Spancrete Machinery Corporation, Milwaukee, Wis.

[21] Appl. No.: 122,544

[22] Filed: Nov. 12, 1987

Related U.S. Application Data

[63] Continuation of Ser. No. 931,921, Nov. 14, 1986, abandoned, which is a continuation of Ser. No. 610,349, May 15, 1984, abandoned.

[51] Int. Cl.[5] ..... E02F 3/00

[52] U.S. Cl. ..... 414/685; 414/690; 414/694

[58] Field of Search ..... 414/690

[56] References Cited

U.S. PATENT DOCUMENTS

| | | | |
|---|---|---|---|
| 3,101,854 | 8/1963 | Kampert | 414/685 |
| 3,777,919 | 12/1973 | Konijn | 280/764.1 X |
| 3,850,473 | 11/1974 | Huber | 414/685 |
| 4,142,642 | 3/1979 | Myers | 414/719 |
| 4,408,949 | 10/1983 | Witty | 414/694 |

FOREIGN PATENT DOCUMENTS

| | | | |
|---|---|---|---|
| 2083932 | 12/1971 | France | 414/685 |

*Primary Examiner*—Robert J. Spar

*Assistant Examiner*—James T. Eller, Jr.

*Attorney, Agent, or Firm*—Andrus, Sceales, Starke & Sawall

[57] ABSTRACT

A small, self-contained portable back-hoe has a wheeled frame with a towing tongue for over-the-road trailering. Pivoted outriggers are connected to the back and a third support is secured to the front of the frame. Cylinder units are coupled to position the supports for digging and in raised position for trailering. The bucket and articulated boom assembly is affixed to the frame with a vertical pivot and includes cylinder units for digging operation thereof. An operator station and a hydraulic power supply source or system is secured to the front of the frame. A special hydraulic supply is integrated into the front framework. The back-hoe boom assembly and operating assembly are balanced about the single axle for convenient positioning. The bucket assembly and three-point support are arranged to minimize the tipping of the frame as a result of the digging forces. A gasoline driven high efficiency industrial-type pump is connected to the cylinder units with a filter and the suction side. A reservoir is built into the front frame structure and includes a watertower element to eliminate air from the hydraulic liquid. The reservoir reliably removes the air from the liquid to avoid pump malfunction.

12 Claims, 5 Drawing Sheets

FIG. 11
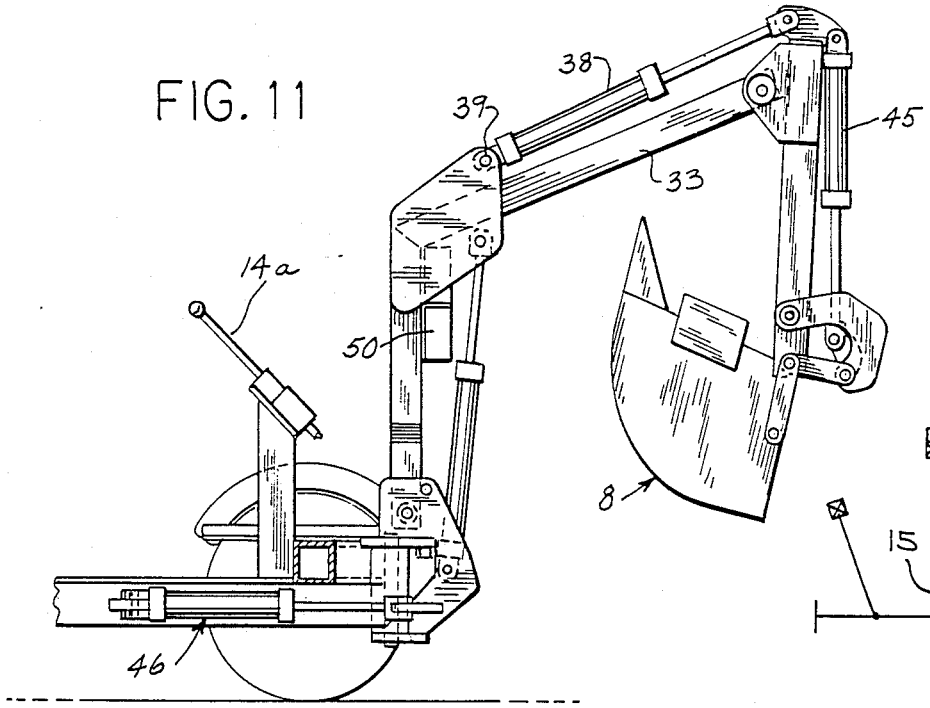
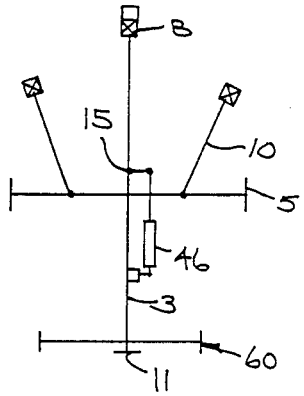
FIG. 13
FIG. 12
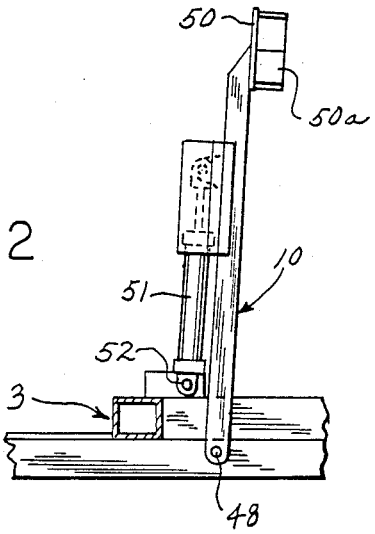
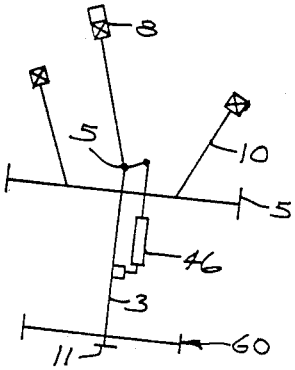
FIG. 14
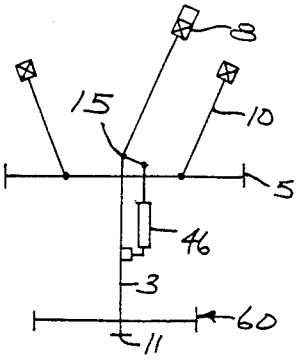
FIG. 15

TRAILERABLE EARTH DIGGING APPARATUS

This application is a continuation of application Ser. No. 06/931,921, filed November 14, 1986, now abandoned, which was, in turn, a continuation of application Ser. No. 06/610,349, filed May 15, 1984, now abandoned.

BACKGROUND OF THE INVENTION

This invention relates to a trailerable earth digging apparatus and particularly to a trailerable backhoe unit adapted to be releasably interconnected to an automobile, pickup truck, or other small over-the-road vehicle for transportation between digging sites.

In building, landscaping and various construction applications, earth moving equipment is required for digging an appropriate hole, trench or the like in the ground.

A backhoe unit is widely used for trenching and other forms of earth digging. In many instances, a rather limited amount of digging is required and conventional large digging apparatus is not essential or desirable.

Earth moving equipment is transported from one site to the next. Earth moving equipment is generally provided with power driven means for moving about the digging site, but the construction is not adapted to over-the-road movement. Although digging equipment such as a backhoe may be available in different sizes, commercially available equipment is generally of a large, heavy construction to permit both large and small excavation and is adapted for transport only on a separate trailer and vehicle.

A backhoe unit, to which the present invention is particularly directed, generally includes a boom-mounted bucket assembly having a pivot support connected to the machine frame structure and a series of interconnected pivot arms interconnectd between the pivot support and a bucket for articulated movement of the bucket. This permits the dropping of the bucket into the earth and then drawing of the bucket towards the main frame for purposes of removing the earth from the ground area.

In the digging operation, the backhoe apparatus must be firmly stabilized to permit creation of the digging forces required for the removal of the earth. In one conventional system, the back-hoe apparatus is interconnected to the back end of an earth moving tractor having a large bucket at the forward end. Alternatively, special back-hoe apparatus is constructed having a supporting wheeled structure and the articulated boom assembly connected to the frame structure. A separate engine-driven hydraulic supply system provides hydraulic power to the several hydraulic motor means connected to the boom assembly and to the machine.

The prior patent art does include suggestion of relatively small digging apparatus of the back-hoe variety and a unit which can be attached to a garden tractor or the like is shown in U.S. Pat. No. 3,362,548 which issued Jan. 9, 1968 to K. G. Cunningham. The back-hoe bucket assembly shown in particularly shown releasably interconnected to the forward end of a two-wheel garden tractor. A coupling unit interconnects a hydraulic operating system to the internal combustion engine of the two-wheel garden tractor. Although this provides a small portable system, the assembly requires separate over-the-road transport apparatus, such as a vehicle and trailer, to conveniently transport the combination between widely spaced digging sites.

U.S. Pat. No. 3,635,364 discloses a further digging apparatus of the back-hoe variety. The apparatus includes a wheeled assembly having a forwardly extended towing mechanism. The wheel structure is pivotally mounted to a frame for raising of the wheel during a digging operation. A towing mechanism extends forwardly beneath the boom, with the boom assembly located between the towing vehicle and the wheel support. This of course creates a significant load on the vehicle during the towing operation, and would normally require a rather large powered vehicle and does not provide convenient on-site movement.

Other patents disclose other back-hoe digging apparatus. For example, see U.S. Patents in which various constructions are shown.

Although, various smaller modifications have thus been suggested, they are not adapted to provide a truly trailerable back-hoe apparatus which can be conveniently interconnected to an automobile or other similar vehicles for transport from site to site. Further, the smaller units do not generally permit significant on-site travel means or significant digging capability.

For example, the inventor does not know of any small back-hoe apparatus which is adapted to digging of a trench to the depth of six to eight feet. Further, none of the devices will permit the convenient trenching or other digging on a significantly inclined terrain.

There is therefore a very significant need for a small, trailerable back-hoe digging apparatus which can be conveniently transported from site-to-site without the necessity of loading on a trailer or the like.

SUMMARY OF THE PRESENT INVENTION

The present invention is particularly directed to a small, compact and self contained portable back-hoe apparatus which has significant digging ability and which is adapted to be directly trailered over-the-road in moving from one site to another. Generally, in accordance with a significant teaching and aspect of the present invention, the trailerable back-hoe apparatus has a wheeled frame assembly with a towing tongue extending forwardly of the front or forward end of the frame. The frame assembly includes support wheels for trailing over-the-road and the assembly is preferably pivotal about the wheel assembly. A digging bucket-mounted boom assembly is pivotally secured to the back or aft end of the frame assembly. A hydraulic supply system, driven by an internal combustion engine, is mounted to the forward end of the frame assembly. An operator console is located between the hydraulic supply system and the boom assembly. The hydraulic supply system and boom assembly are constructed and arranged with respect to the wheel assembly to provide an essentially balanced state about the wheel assembly. The construction and arrangement is preferably such that with the bucket assembly folded to a compact position adjacent to the back end of the frame assembly, the unit is adapted to be towed between work sites. In such position, the unit preferably creates a slight towing load on the towing tongue. With the bucket assembly extended in an anticipitory digging position, an essentially balanced state is created about the wheel assembly. The present trailerable apparatus in a preferred construction is balanced about a single axle wheel assembly which permits the operator to conveniently position and move the unit on site. The bucket position controls the balance and in the trailering position provides a tongue load.

Thus, during towing the apparatus is maintained in an appropriate position for convenient and reliable stable towing over-the-road. At the site the trailerable back-hoe unit is readily placed in the balanced condition for manual positioning and movement on-site.

In a further aspect of the invention related to on-site movement, the forward end of the frame assembly spaced from the wheel assembly is provided with a pair of small on-site transport wheels. The wheels are small and normally raised in the trailering or digging positions and lowered for on-site moving of the apparatus. The unit can be readily moved on-site manually or by manipulation of the bucket upon the ground to create an appropriate pulling or pushing force. In the lowered on-site wheel position, the balanced apparatus is of course supported on four wheels defining a mobile vehicle.

This balanced design not only allows easy forward and aft movement by manipulation of the boom and bucket, but also permits the whole unit to be moved directly sideways by providing suitable support of the forward portion of the apparatus by articulating with the boom to load the trailer wheels or alternatively the forward support, and thereafter extending or contracting the boom assembly to cause lateral movement. The ability to move sideways is extremely valuable in close quarter digging environments.

In a preferred construction of the present invention, a wheel axle assembly is coupled to the framework adjacent the boom mounting to the framework. The operator station and a hydraulic power supply source are secured to the frame to the opposite side of the axle assembly. The controls are located conveniently adjacent to the axle position. A special hydraulic supply tank is integrated into a vertical framework adjacent the front of the frame and includes a reservoir and supply interconnection to the hydraulic pump assembly. The total assembly is specially constructed and arranged to provide the essentially balanced construction with respect to the forward and aft side of the wheel assembly with the bucket assembly in a fully extended and raised work position. In this position, a single operator can readily lift either end of the trailerable back-hoe apparatus for moving and by applying lateral forces turning the unit about the wheel support. Thus, with this simple balance arrangement, the operator can manually position the back-hoe apparatus at the site.

In an important aspect of the invention, outriggers are connected to aft end of the frame structure by similar horizontal pivot units, and a third vertical support element is secured to the front center of the frame assembly to provide a retractable 3-point support. Similar power cylinders are coupled to the individual outriggers for locating the aft units between an outer inclined support position for digging and a raised vertical position for trailering. Similarly, the third support unit is coupled to a power cylinder unit and is movable between a raised transport position and a lowered digging position. The outrigger power cylinders are preferably coupled to the hydraulic supply to permit infinite and independent adjustment of the placement of the outriggers with respect to the ground and each other.

In a highly significant and unique construction, the bucket articulated arms and bucket assembly are interconnected to the frame in conjoint relationship to the outriggers to provide a conjoint force interaction between the bucket forces and the supporting forces which essentially eliminate the digging force of the bucket from being transmitted in a tipping manner to the frame assembly. The result of this conjoint interrelationship of the force planes is such that the small, compact, trailerable back-hoe can effect significant trenching and other digging without the necessity of significant counterbalancing weights, and can operate safely upon hills and uneven terrain. More particularly, in this aspect of the invention, the apparatus is constructed with the boom pivot assembly connection to the frame and the outrigger pivot connections to the frame structures being essentially coincident such that the forces are substantially similarly applied to the frame structure. In addition, the triangular support defined by the rear outriggers and the front support element define a substantially equilateral triangle with the force applied at the center point thereof. The force locations minimize the creation of a lever arm relationship between the bucket forces and the balancing outrigger forces as applied to the frame structure and thereby eliminate the creation of tilting or tipping forces on the apparatus. As a result, the back-hoe is capable of exceptional digging capabilities. The inventor has built a small 1200 pound trailerable, self-contained back-hoe capable of trenching to a depth in excess of six feet without the use of any significant counterbalancing apparatus. Further, because of the stabilizing effect of the mounting, the back-hoe apparatus in combination with the infinitely adjustable outriggers can dig on inclined and uneven surfaces without significant loss of stability.

The hydraulic source is preferably a self-contained unit having a small gasoline driven, high efficiency industrial-type pump. Such high efficiency pumps are generally not suitable for use in earth moving equipment or the like because of the working environment which creates contamination of the hydraulic liquid from the surrounding environment. In such high efficiency pumps, even minor contamination of the liquid can rapidly destroy the pump. A filter unit is therefore desirably applied to the suction side of the pump. This latter pump connection has not generally been considered practical and the fact the inventor was informed his system would not work. The filter at the suction location was generally considered to create air in the liquid supplied to the pump, resulting in possible malfunctioning of the hydraulic devices. The inventor, however, discovered that by appropriate construction of the reservoir to create a watertower effect which reliably removes air from the hydraulic liquid immediately in front of the filter and suction connection, a completely satisfactory pump operation is obtained.

The hydraulic system includes a reservoir which is another feature of an optimum structure and is formed as a part of a vertical rectangular frame structure secured at the front of the frame and adjacent the operator station. The rectangular frame is formed of tubular frame members having the front frame member connected to vertical side frame members. The lower and one side frame members are connected to define a reservoir with the suction pump connection made at one end of the lower frame members remote from the vertical frame member. The hydraulic liquid return is made to the vertical frame member. A baffle plate or other means is connected at the junction of the bottom or lower side frame members or other appropriate location. The baffle may be formed as a simple apertured plate. An air release unit is connected to the uppermost end of the side reservoir to automatically release air from the upper end of the reservoir. In operation, the returning hydraulic fluid may be aerated and as the fluid flows downwardly through the side reservoir chamber and the baffled opening into the lower reservoir chamber, the air in the fluid is released and inherently rises upwardly for discharge from the upper portion of the vertical reservoir chamber. The hydraulic liquid is therefore supplied to the lower reservoir chamber and thus to the pump essentially air-free, and may be readily applied to the filter for supplying the high efficiency industrial-type hydraulic pump.

The self-contained, integrated, trailerable, back-hoe apparatus thus has all of the elements and components appropriately affixed to the supporting frame structure or assembly either in an appropriate fixed relationship or in a pivoted relationship, with hydraulic power means for selective positioning of the desired movable components between a trailering position, a transport position or a digging position. The user need not disassemble or assemble any of the components with respect to the frame assembly or other components to use the apparatus or to place the apparatus on the state for towing. As a result, the operator can move directly to the site, place all components, through the appropriate powered means, in the digging position and proceed with the digging operation.

The trailerable back-hoe apparatus of the present invention further preferably incorporates various other unique features in an optimum functioning trailerable back-hoe apparatus as more fully shown in the preferred embodiment.

DESCRIPTION OF THE DRAWING FIGURES

In the drawings:

FIG. 11 is a fragmentary view similar to FIG. 7 illustrating the collapsed and transport position of the bucket assembly;

FIG. 12 is a fragmentary view of an outrigger illustrating the raised transport position of the outrigger assemblies; and FIGS. 13–15 are line diagrams of the lateral movement of the apparatus.

DESCRIPTION OF THE ILLUSTRATED EMBODIMENT

Figure 1:
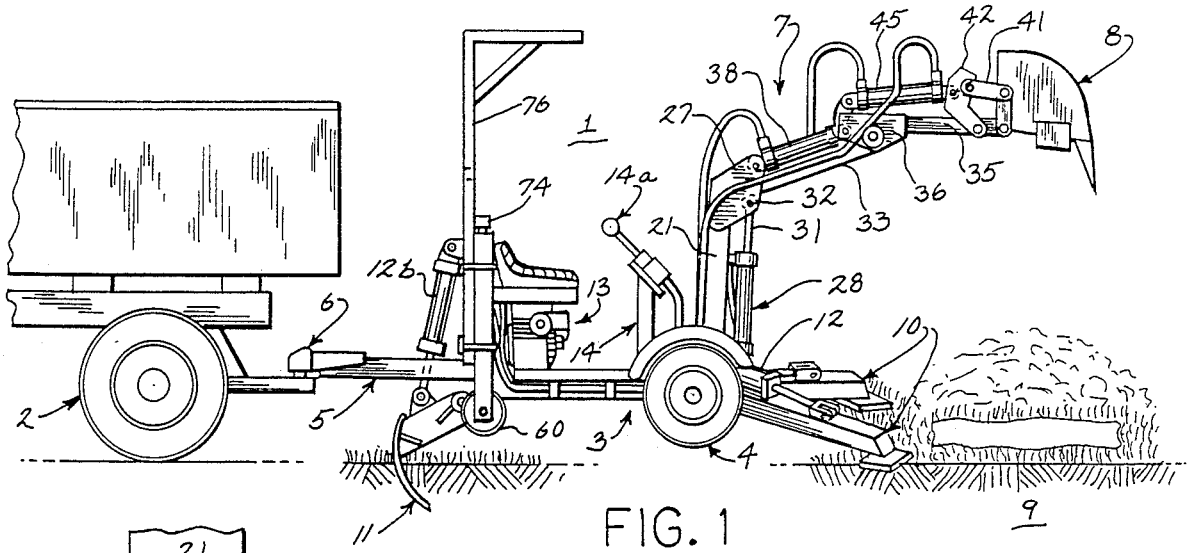
FIG. 1 is a side elevational view illustrating a back-hoe apparatus or unit constructed in accordance with the teaching of the present invention.
Figure 9:
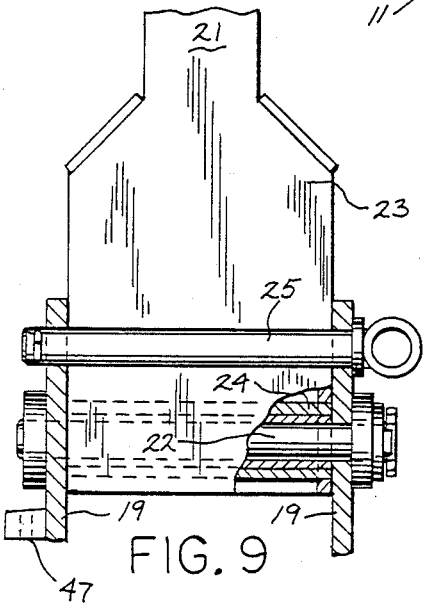
FIG. 9 is a view taken generally on line 9—9 of FIG. 8.
Figure 8:
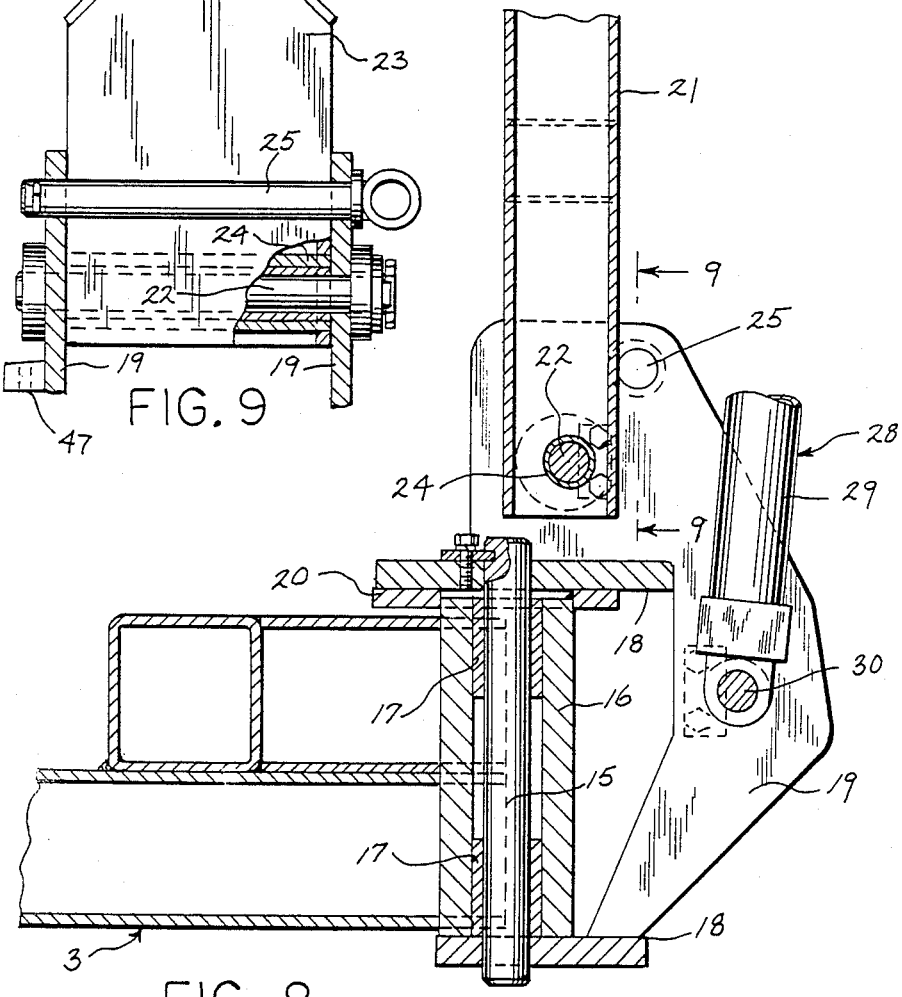
FIG. 8 is a vertical section through the boom assembly connection to the supporting frame.
Figure 2:
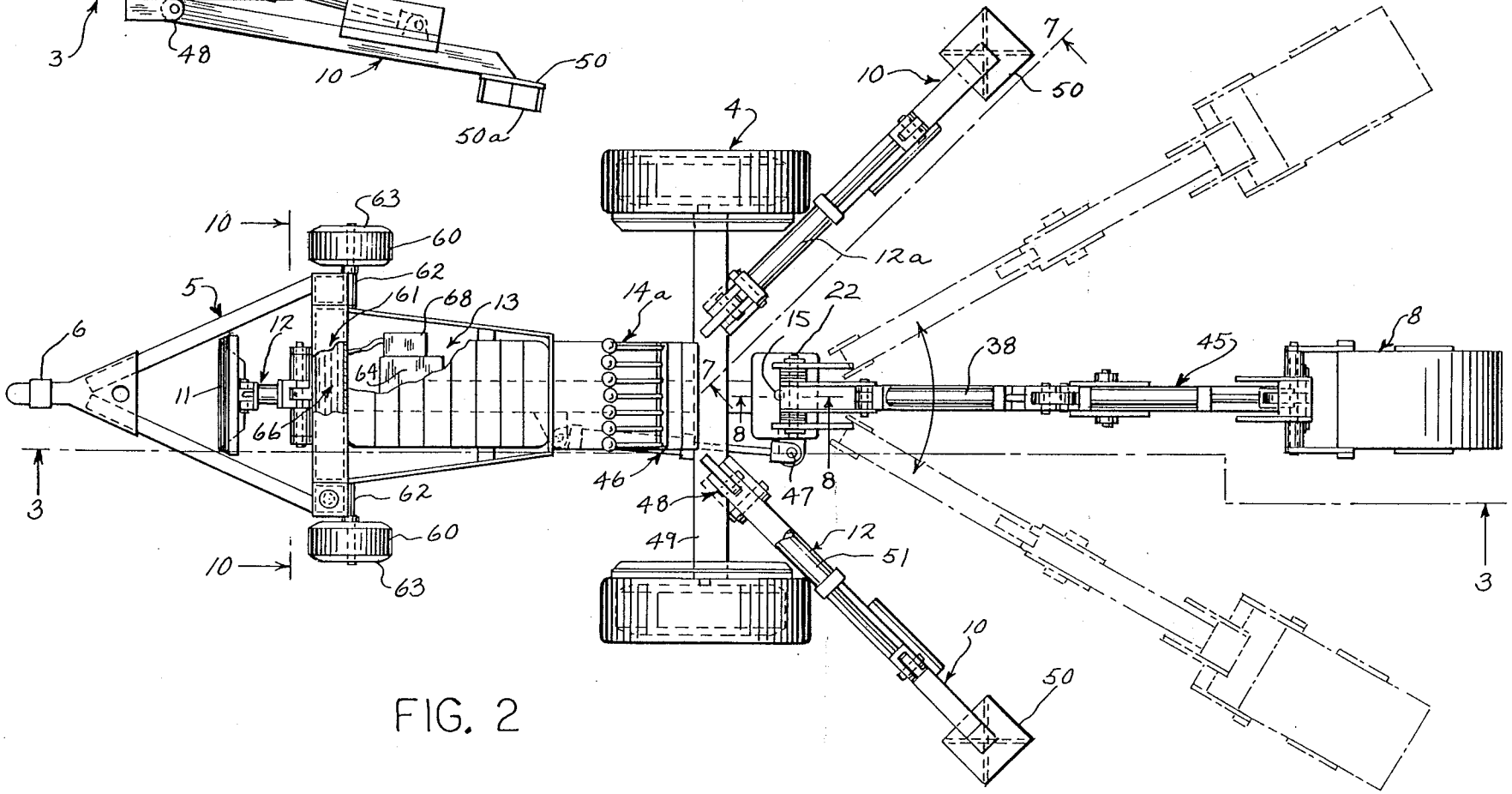
FIG. 2 is a plan view of the apparatus shown in FIG. 1.
Figures 3, 5, 6:
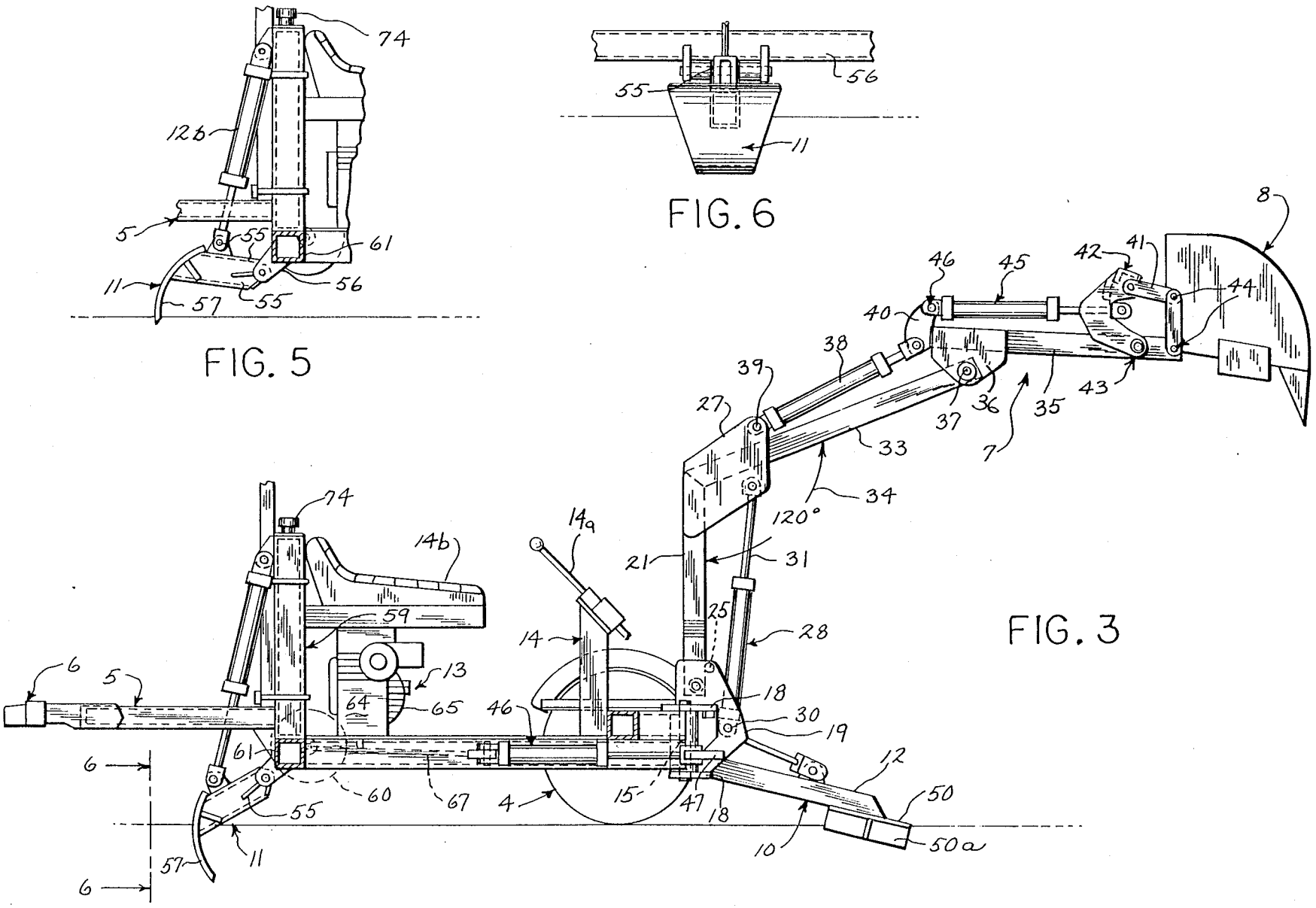
FIG. 3 is an enlarged side view of the apparatus shown in FIGS. 1 and 2.
FIG. 5 is a fragmentary side view of the apparatus showing a forward support element in an alternate position from that shown in FIG. 3.
FIG. 6 is a fragmentary view taken generally on line 6—6 of FIG. 3.

Referring to the drawings and particularly to FIG. 1, a back-hoe apparatus 1 constructed in accordance with the teaching of the present invention is shown coupled to a conventional automobile 2 for over-the-road transport. The back-hoe apparatus is a self-contained digging assembly and includes a supporting wheeled frame structure 3 having a single axle wheel unit 4. A towing bar 5 is connected to the front end of the supporting frame structure 3 and is adapted to be interconnected to the automobile 2 by a conventional ball hitch 6. As more fully developed hereinafter, the back-hoe apparatus includes a boom assembly or unit 7 connected to the rear end of the frame structure 3 opposite the towing bar 5. The boom assembly 7 includes a series of articulated arms for moving a bucket 8 into and through the ground 9 for removal of the ground in a more or less conventional manner. A pair of similar outriggers 10 are secured to the frame structure 3 immediately adjacent to the boom assembly 7. The outriggers 10 are leg members which are adapted to be extended outwardly for digging or folded inwardly for transport. A third support member 11 is secured to the forward end of the frame structure 3 and is vertically movable between a lowered digging position and a raised transport position. In the digging position, the outriggers 10 and support element 11 define a substantially equilateral triangle, as shown in FIG. 2. The boom assembly 7 as more fully developed hereinafter is affixed to the frame structure 3 generally centrally between the outrigger pivot supports and substantially in alignment with such pivot supports, as shown in FIGS. 3, 8 and 9. This results in the bucket-generated forces and reaction forces being applied to the frame structure 3 with a minimum of tipping forces.

Outriggers 10 and the stabilizing support or foot 11 as more fully developed hereinafter are provided with hydraulically actuated power cylinder units 12, **12*a* and 12*b* for moving the members between the folded transport position and the working or digging position in the ground. A small internal combustion engine driven hydraulic pump unit 13 provides a source of pressurized hydraulic liquid for operating the system from a control station 14. Thus, the control station 14 includes a plurality of hydraulic control levers 14*a* for operating of the boom assembly 7, positioning of the outriggers 10 and support 11. The control station 14 is located forwardly of the wheel unit 4 while the pump unit 13 is located in forwardly spaced relation at the front of the frame 3 adjacent to an operator seat unit 14*b*. The total assembly is arranged and constructed to provide a substantially balanced loading of the apparatus about the axle of the wheel unit 4**.

The back-hoe apparatus is a compact, self-contained apparatus which is readily trailerable over-the-road by the releasable ball-hitch attachment to the aft end of an automobile, small truck or the like. All of the elements and components of the apparatus are specially interconnected to remain attached to the support frame structure 3 and define a single integrated apparatus which is moved as a unit, with convenient hydraulically operated means for positioning the elements and component in either the working and digging position or alternately in a folded transport position. This completely eliminates the necessity for a special trailer, towing vehicle or other complex towing requirements such as generally used for over-the-road transport of earth moving equipment.

More particularly, when arriving at the digging site, the operator may manually position the back-hoe unit 1 in the digging area, actuate the outrigger and stabilizing foot positioning means and thereby position the apparatus for digging operation. The single forward support 11 interacts with the outrigger 10 to provide a stable three-point support for the digging apparatus.

More particularly, as shown in FIGS. 2, 3, and 8, the boom assembly 7 includes a pivot pin 15 secured to the rearward portion of the frame 3. The pin 15 is rotatably mounted in a bearing tube or sleeve 16 which is welded or otherwise rigidly connected to a mounting bracket assembly secured to the rear member of the pin radially. A boom bracket assembly includes upper and lower plates 18 which pivotally connect to the opposite ends of pin 15 and define a substantially U-shaped configuration. Plates 19 are welded or otherwise rigidly affixed to the end plates 18. The upper plate 18 rests on a bearing plate 20 welded to the upper end of tube 16.

the articulated bucket arm unit 7 is secured to the bracket plate 19 and includes a first arm 21 secured to the bracket plate 19 by a horizontal shaft 22 secured between the brackets. As shown in FIGS. 8 and 9, the lower end of arm 21 is formed with an enlarged box-like frame portion 23 having a bearing sleeve 24 secured therein. The sleeve 24 is journaled on shaft 22. A stop pin 25 is releasably secured within the plates 19 upwardly of shaft 22 and provides a mechanical stop and support for the arm 21.

Figure 4:
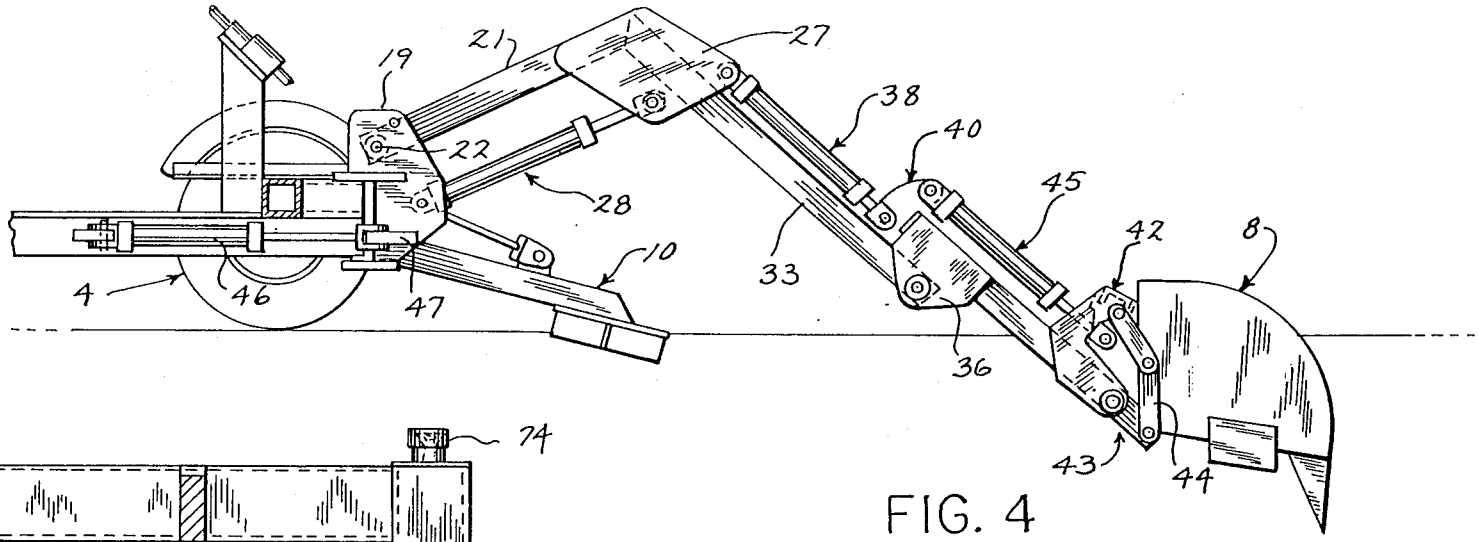
FIG. 4 is a fragmentary side view of the apparatus with the bucket and boom assembly in an alternate position.

Referring to FIG. 3, a double-plate top bracket unit 27 is rigidly affixed to the upper end of the arm 21 for connection to the other arms as presently described. A positioning piston/cylinder unit 28 vertically supports the tube and bracket. The piston/cylinder unit 28 is shown including a cylinder 29 pivotally secured to the bearing support bracket plates 19 as at 30 and a piston rod 31 which projects outwardly of the outer end. The piston rod 31 is pivotally secured to the underside of top arm bracket 27 and thus the articulated arm 21. The piston/cylinder unit 28 is supplied with a hydraulic liquid for pivoting and thereby raising and lowering of the arm between the vertical and horizontal positions for proper back-hoe digging operation as shown in FIGS. 1, 3 and 4. The supply of hydraulic liquid is controlled at the control station 14.

An outer angled arm 33 is pivotably secured to the upper end of the vertical arm 21 and projects substantially normal to arm 21. As shown, the arms 21 and 33 define an inclusive angle of about 120 degrees, as shown at 34 in FIG. 3.

A second arm 35 is pivotally secured to the outer end of the arm 33 as by a pivot bracket 36 secured to the underside of the second arm 35 and the ends of arm 33. The pivot connection 37 of the second arm is made slightly inwardly from the pivoted end of arm 35. A second piston/cylinder unit 38 is interconnected to the first arm bracket 27 by a pivot connection 39 and to the end of the second arm 35 by a pivot bracket 40 secured to the end of arm 35 for selective relative pivoting of the arms.

The bucket 8 is a conventional type. A pivot bracket 41 is secured to the back wall of the bucket. A bracket linkage 42 is pivotally secured to the outer end of the second arm 35 as at 43 and to the bucket as at 44. Piston/cylinder unit 45 is pivotally interconnected at the opposite ends extending between an extension 46 of bracket 40 and the bucket linkage 42 for pivoting of the bucket relative to the articulated arm assembly 7.

By appropriate manipulation and powering of the several power piston/cylinder units 28, 38 and 45, the articulated arm structure 7 and bucket 8 is moved to dig into the ground by dropping of the bucket 8 onto the ground and pulling it toward the frame assembly 3, generally in accordance with known back-hoe operation.

In addition, a piston/cylinder unit 46, as shown in FIG. 2 is secured between the frame 3 and an arm 47 on the vertical sleeve and particularly bracket plates 19. The piston/cylinder unit 46 is operable to rotate the sleeve for swinging movement of the boom assembly 3 and appropriate lateral movement of the bucket 8.

The stabilizing and support components or legs 10 and 11 are similarly hydraulically powered.

Figure 7:
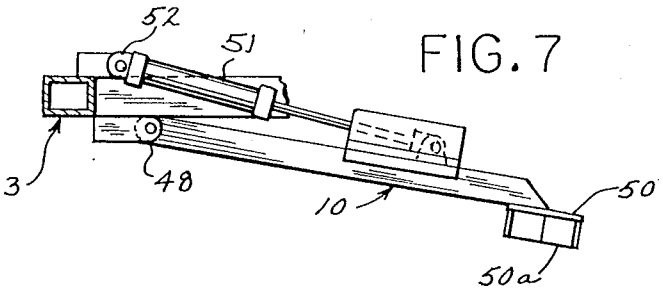
FIG. 7 is a fragmentary view of a supporting outrigger shown in FIGS. 1–3.

Referring to FIGS. 2, and 7, the pair of rear stabilizing legs 10 are similarly pivotally interconnectd as at 48 to a cross member 49 of frame 3 to the opposite sides of the vertical pivot pin 15. The legs 10 are elongated box-like members terminating in supporting pads 50 in the form of plate-like members having downwardly projected plates **50*a*. Power/cylinder units 12 and 12*a* are interconnected to the legs 10 and to the frame structure as at 52. The legs 10** are adapted to be positioned between a folded trailering position and an extended operating position.

The leg structure in the extended operating position extends laterally, rearwardly, and outwardly into a stabilizing support with pads 50 resting and projecting into the ground. With both of the legs in the extended position, a relatively wide base is created which is spaced outwardly of the supporting frame.

Additionally, the third stabilizing foot 11 is secured to the forward end of the frame 3 which in combination with the stabilizing legs 10 defines the triangular or three point support.

The front foot includes a vertical pivot arm 55 pivotally secured to a front frame member 56. The foot 11 includes a curved plate 57 secured to the outer end of arm 55. The plate 57 is adapted to be pivoted from a raised vertical transport position to move beneath the frame 3. The curved plate 57 extends from arm 55 and is adapted to be pivoted downwardly into the ground as shown in FIG. 3 to define a second supporting position for supporting of the assembly. Piston/cylinder unit **12*b* is connected between the pivot arm 55 and the upper end of front vertical frame 59. The piston/cylinder unit 12*b* provides for powered positioning of foot 11. The curved plate 57 is readily moved into the ground to firmly hold the front of the assembly against movement. The curved plate 57** creates a simple slice in the ground which can be readily repaired by pressing on the ground, usually with the worker's foot.

For working with the apparatus on blacktop or the like the front of the apparatus is normally left attached to the towing vehicle to firmly support the apparatus. A typical operation would be breaking of a blacktop surface.

The lightweight construction particularly adapts the apparatus for an on-site mobility. In this respect, auxiliary supporting wheel units 60 are preferably provided to the forward end of the apparatus. In the illustrated embodiment of the invention, a pair of similar type wheel units 60 are shown mounted to the opposite ends of the front cross beam member 61 of the frame. Each wheel unit 60 includes a support member 62 secured to the frame 61 and a small diameter wheel 63 such as a 10 or 12 inch diameter. The wheel 63 is journaled on the lower end of the support. With the forward stabilizing unit 11 raised, the wheels 63 rest on the ground. In this position, the back-hoe apparatus 1 is movably supported upon the on-site transport wheels 63 and the large over-the-road wheels 4. The apparatus is conveniently moved manually or by dropping the bucket 8 into engagement with the ground and extending or drawing the bucket inwardly to effect a corresponding forward or reverse movement of the apparatus.

This balanced design not only allows easy forward and aft movement by manipulation of the boom and bucket, but also permits the whole unit to be moved directly sideways by providing suitable support of the forward portion of the apparatus by articulating with the boom to load the trailer wheels or alternatively the forward support, and thereafter extending or contracting the boom assembly to cause lateral movement as shown in FIGS. 11–13, inclusive, as follows:

As shown in FIG. 13, to establish lateral leftward movement of the apparatus, the bucket unit 8 is extended outwardly in line with frame 3. The rear extended out riggers 10 and front plate 11 are raised just off the ground, and the apparatus extended to (1—1) lower the bucket in the extended position lightly on or close to the ground to put weight on rear wheel assembly 15, and as a result front wheels 60 are effectively unweighted and may lift slightly from the ground, and then (1-2) extend the pivot cylinder 46 to exert a turning force which pivots the apparatus about vertical shaft and rear assembly 5, with front wheels 60 and the front of frame pivoting to the position of FIG. 14. To complete the lateral movement, the apparatus is further activated as follows, with reference to FIG. 12 (having riggers 10 and front plate 11 in the same state) (2-1) to drop the bucket 8 to the ground and collapse the arm assembly of the bucket assembly to exert a lifting force on the bucket, which transfers the weight and force to the front wheels assembly from ground, and causes the rear wheel assembly and front of frame to pivot counterclockwise to the position of FIG. 15. The operator can then actuate apparatus to dig in the laterally moved position of FIG. 15. Further, movement requires positioning the bucket 8 to recycle steps 1 and 2 as described above for further lateral movement. The ability to move sideways is extremely valuable in close quarter digging environments. It could be compared to having this ability in an automobile and being able to maneuver squarely sideways into a tight parking spot. This is in contrast to the prior art which must be maneuvered forward and back on an angle, much like a conventional automobile to accomplish a parallel repositioning.

The three leg or point support for the apparatus in the digging position is preferably constructed and arranged to define an essentially equilateral triangle, as shown in FIG. 2, and which encompasses the frame structure and locates the vertical boom pivot pin support including pin 15, sleeve 16, and plates 18 generally at the internal common point of the triangle.

In addition, as previously noted the stabilizing legs are specially pivotally supported to increase the stability of the overall back-hoe support. In particular, the pivot points and load forces are located to minimize the torque arm created by the boom assembly 7 on the stabilizing legs 10–11. In particular, the pivot connection of the piston/cylinder unit is secured to frame 3 generally in line with the boom pivot connections and located closely adjacent thereto. This provides a stable and high force digging apparatus. Thus, applicant has found that with a machine having a dead weight of approximately 1500 pounds with a frame structure of 61 inches from wheel to wheel and a length of 13 feet retracted. The triangle has a side with a length of about 8.6 feet between the outriggers and two sides with a length of about 9 feet between the two outriggers and the front support 11. The boom assembly extends outwardly about 9 feet in a fully extended. Trenching could be accomplished to a depth substantially 6 feet which heretofore required relatively much heavier equipment. Thus, the apparatus has satisfactorily dug trenches in excess of six feet deep and in certain conditions to eight feet deep without instability within the apparatus.

The several power piston/cylinder units are each identical double acting units. The several units are connected to the hydraulic pump unit by individual control levers **14*a* provided at the control station 14. Thus, the operator can individually control each of the piston/-cylinder units for appropriate positioning of the stabilizing leg units 10–11 as well as the manipulation of the boom assembly 7 and bucket 8** for digging.

The hydraulic supply 13 for the piston/cylinder units includes a high precision hydraulic pump 64 such as a Webster Y B model, 2.34 gallons manufactured and sold by Webster. An internal combustion engine 65 is coupled to drive the pump 64 and provide a circulation of hydraulic liquid from a reservoir 66 formed in the front frame cross beam 59 to the several piston/cylinder units, under the control from the piston/cylinder units to the reservoir. The engine can be a small internal combustion engine such as an 8 horsepower industrial type engine sold by Briggs & Stratton of Milwaukee, Wisconsin or any other similar or suitable small two cycle or four cycle engine.

The use of a high efficiency pump 64 permits a small compact pump unit, while providing the necessary high pressure for operating of the bucket assembly for digging and the like as well as for positioning of the supporting stabilizing legs. The pump 64 includes an hydraulic output connected to a distribution line 67 for supplying of hydraulic liquid to one end of the power piston/cylinder unit in accordance with the setting of the corresponding control lever **14*a*. The reservoir 66 supplies hydraulic liquid to the suction side of the pump 64** and also accumulates the return hydraulic liquid from the piston/cylinder units.

The high efficiency pump 64 is extremely sensitive to foreign mediums in the hydraulic liquid. The hydraulic liquid thus supplied to the suction side of the pump 64 from the reservoir 66 must be free of air and other gases as well as all other foreign matter to provide a useful pump life. In accordance with a preferred and unique construction of the present invention, a filter unit 68 is located between the reservoir 66 and the input or suction side of the pump 64. Although such a construction is contrary to the generally accepted practice, the inventor has found that the special construction of reservoir 66 provides a completely satisfactory operation of apparatus with a long life.

Figure 10:
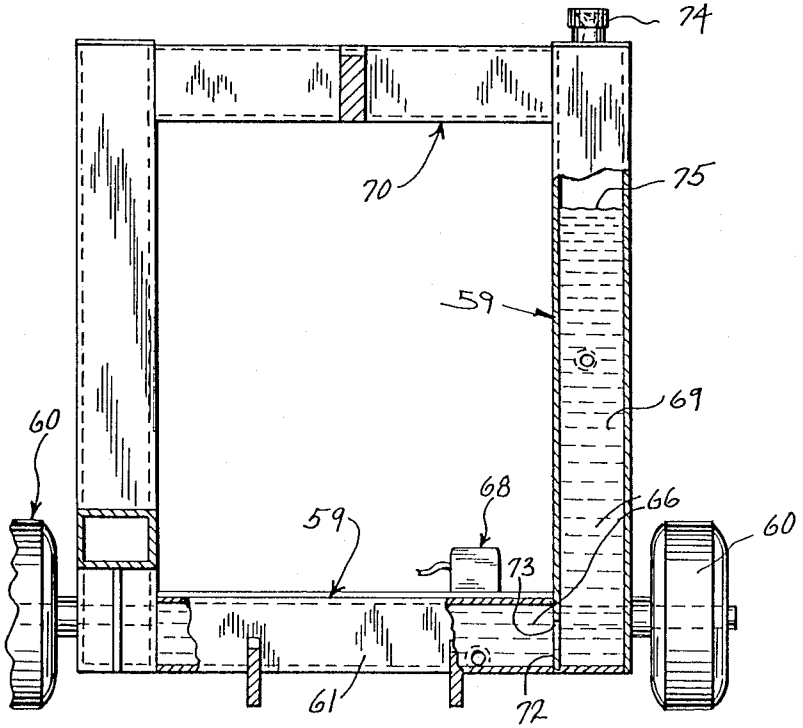
FIG. 10 is a vertical section taken generally on line 10—10 of FIG. 1, and illustrating a front vertical bracket support frame with an integrated hydraulic reservoir.

As more particularly shown in FIG. 10, the reservoir 66 is formed as a part of the front frame member or leg 61 secured to the forward end of the mobile frame 3. The member 61 is the lower leg of a rectangular front frame which extends upwardly in front of the pump and seat sections, and includes a pair of vertical legs 69 and a top cross beam 70. The several legs or sides of the front frame are formed of box beams. Generally, the sump or reservoir 66 is formed in the vertical side leg 69 as follows. The illustrated sump or reservoir is formed in the bottom leg 61 and the one vertical side leg 69, shown as the right leg in FIG. 10. The filter 68 is connected to the bottom leg 61 adjacent the end opposite the vertical reservoir leg 69. The return liquid is supplied to the upper portion of the vertical leg 69. A baffle plate 72 including a flow restriction opening 73 is connected within the front frame at the junction of the vertical and horizontal legs 69 and 59. The aperture plate 72 creates a restrictive flow passageway for the hydraulic liquid. A gas release valve 74 is secured to the upper end of the vertical leg 69 above the maximum level of the hydraulic liquid 75. In operation, the liquid 75 is circulated from the sump or reservoir to the pump, flowing from the vertical leg 69 into the horizontal leg 61 through the restriction 73. This provides a substantial flow path with relatively slow flow of the liquid through the reservoir. The baffle 72 functions to restrict the flow and thereby produce a system wherein any air or other fluid trapped within the liquid 75 is released within the vertical sump leg 69 and released into the atmosphere via the fluid release valve 74. The slow flow essentially eliminates significant turbulance in the horizontal leg 61. The flow through the orifice plate 73 created by the aperture plate tends to insure release of all gases such that only gas-free liquid is drawn from the sump. Any solid foreign matter is filtered out by the filter unit 68, also without significant turbulance, thereby permitting the effective operation of the high efficiency pump unit.

A generally L-shaped extension 76 may be secured to the upper end of front frame and projects upwardly from the upper side legs 69 and top crossbeam and forwardly over the drivers position or station. This extension is also formed of box-beam members to create a rigid, roll-bar structure at the operator station. In the unlikely event of tilting or rollover, the operator is protected.

The apparatus is preferably uniquely constructed to provide an essentially completely balanced condition about the over-the-road single axle wheel assembly 4. In this aspect of the invention, the reservoir, engine, pump and front support and wheel assembly, including the hydraulic control unit slightly forwardly of such wheel assembly 4, creates a load on one side of the wheel assembly 4. The boom assembly 7 and bucket 8 are mounted slightly rearwardly of the wheel assembly 4 and creates a counterbalance force. With the boom assembly 7 and bucket 8 extended outwardly in a raised and horizontal position as in FIG. 1, a counterweight and balancing load to the components forwardly of wheel assembly 4 is created. In this state or condition, the total assembly is essentially balanced about the wheel assembly 4 and can be readily moved at the site by manually rotating and pushing the assembly. Thus the apparatus can be most conveniently and rapidly located on-site without the necessity of heavy equipment such as a truck or other vehicle moving over the site area. This is particularly significant and important where work is being done on a lawn, garden area and the like wherein the truck or other vehicle may cause significant damage to the ground area. During digging, the system also establishes a stable support for the apparatus.

During transport, the apparatus is preferably arranged with a slight load on the towing bar 5. With the boom assembly 7 and bucket 8 as well as the legs 10 raised in the folded position, the load is redistributed about wheel assembly 4 to create the desired load on the tow bar 5. This construction further contributes to the high speed towability of the apparatus with a small vehicle such as a pick-up truck, automobile or the like.

Various modes of carrying out the invention are contemplated as being within the scope of the following claims and particularly pointed out and distinctly claiming the subject matter which is regarded as the invention.

I claim:

1. A self-contained trailerable back-hoe apparatus adapted for direct over-the-road trailering by an automobile-type vehicle, comprising a support frame having a front trailering hitch means, a wheel assembly affixed to the frame and including back wheel means including laterally spaced rotating back wheels having an axis extending transversely of the front to back of the frame and supporting the back-hoe as a two-wheel trailer unit for over-the-road trailering at normal over-the-road speeds, said wheel assembly including laterally spaced front wheel means secured to the support frame forwardly of said rotating wheels and located above ground level during over-the-road travel and located to support the frame with the frame detached from the vehicle, a three point dig-stabilizing means connected to said frame and including first and second individual support means secured in laterally spaced relation to the frame to the back of said wheel assembly and a third individual support means secured to the frame to the front of said wheel assembly and located centrally of said pair of individual support means, said stabilizing means including powered means connected between the frame and each of said individual support means for moving the support means between a raised transport position and a lowered ground-engaging digging position, said third support means having a lower cutting edge for forcing the third support means into the adjacent ground and projecting downwardly and rearwardly of the frame, and establishing a horizontal holding force opposing the horizontal and vertical forces of the bucket for digging, a vertical pivot support secured to said frame rearwardly of said wheel assembly, an articulated back-hoe digging arm assembly rotatably mounted on said vertical pivot support, a bucket secured to the outer end of said arm assembly, said arm assembly having a position to establish a balanced loading on the frame about said laterally spaced back wheels to permit convenient moving of the apparatus on-site, power means connected to said arm assembly for pivoting said arm assembly about said vertical support, said arm assembly including a plurality of articulated arm members adapted to be selectively extended and contracted and to selectively place said bucket in ground engagement for digging with said three point stabilizing means in ground engagement and for moving the apparatus with said frame supported by said wheel assembly, said apparatus being movable substantially directly perpendicular to the front to back of said frame by manipulation of said arm assembly and bucket with selective engagement of the bucket with the ground and by rotating said arm assembly about said vertical pivot support, and bucket control powered means connected to said frame and to said arm assembly and connected to said arm members for positioning said bucket and said arm assembly and said arm members.

2. The apparatus of claim 1 wherein said arm assembly includes a vertical arm pivotally attached to said vertical pivot support and a horizontal boom arm secured to and extending from said vertical arm, a bucket arm pivotally secured to the outer end of said horizontal boom arm, said power means includes hydraulic powered means connected between the boom arms and bucket arm for selective moving and pivoting of the bucket arm and bucket in a substantially vertical plane and hydraulic power means connected between the frame and the boom arm for pivoting the vertical arm and boom arm, said power means including a hydraulic power means connected between said frame and said vertical arm for pivoting said arm about said vertical pivot support.

3. The back-hoe apparatus of claim 2 wherein said hydraulic means including a front hydraulic power means connected to the front dig stabilizing means for raising and lowering and to said front dig stabilizing means, said raising of said dig stabilizing means moving said frame and front wheel means downwardly into ground engagement.

4. The apparatus of claim 2 wherein said boom assembly creates a load on the hitch means of the transport frame with the boom assembly in a collapsed transport position.

5. The apparatus of claim 1 wherein said each of said powered means is hydraulic actuated means, and having a substantially forward vertical structure including at least one substantially horizontal bottom frame leg and side frame legs, said reservoir being formed by said legs, a hydraulic liquid substantially filling said reservoir, a rotary pump unit mounted to said frame adjacent said reservoir and connected to said reservoir, and a hydraulic control unit mounted in front of said back wheel means and including an individual control for each of said hydraulic power means connected to said pump unit for manipulation of said boom and bucket assembly and said stabilizing means.

6. The portable trailerable back-hoe apparatus of claim 1 wherein said first and second support means each includes an elongated stabilizing leg pivotally connected to one side of the frame adjacent the rearward most end of the frame, said powered means including a hydraulic cylinder power unit connected to the frame and to the leg and operable to raise the leg to a substantially vertical transport position and pivotal downwardly to a ground engaging stabilizing position, said power unit being pivotally connected to the frame above the pivot connection of the leg to the frame and generally in the plane of the force application of the boom assembly to the frame to thereby minimize the tilting forces applied to the frame and legs by the boom assembly, and said third support means includes a front stabilizing leg having a plate member projecting into the ground between the rear stabilizing legs in a digging position, said plate being curved from the vertical direction and the lower edge projecting rearwardly toward the digging arm assembly in the digging position.

7. The portable back-hoe apparatus of claim 6 including an operator station located forwardly of said wheel assembly and including a plurality of control members, a hydraulic pump assembly located forwardly of said wheel assembly and said operator station, and including a hydraulic reservoir and pump, said pump establishing hydraulic flow from the reservoir to said hydraulic power means.

8. The trailerable back-hoe apparatus of claim 1 wherein said support frame includes a longitudinal frame member and a front crossbar connected to the forward end of the member and a rearward wheel cross axle, said vertical pivot support includes a vertical pivot shaft rigidly affixed to the longitudinal frame member rearwardly of said cross axle and having a vertical pivot axis, a pivot bracket mounted on said pivot shaft, said arm assembly including a first substantially vertical arm member pivotally connected on said bracket for pivoting about a horizontal axis and including a horizontal arm rigidly secured to the outer end of said first arm member and extended horizontally outwardly from said first arm member, said boom assembly including a bucket arm pivotally secured to and projecting outwardly of the outer end of the horizontal arm, said bucket being pivotally secured to the outer end of said bucket arm, said power means includes a hydraulically powered cylinder unit interconnected between the bracket and the horizontal arm and a hydraulically powered cylinder unit connected between the horizontal arm and bucket arm and a hydraulically powered cylinder unit connected between the bucket arm and the bucket for selectively moving and pivoting of the bucket in a substantially vertical plane for digging and moving the apparatus over the ground.

9. The apparatus of claim 8 wherein said hydraulically powered cylinder units are each double-acting piston and cylinder units.

10. A portable trailerable back-hoe apparatus comprising a single axle wheel assembly, a supporting frame having a front portion secured to the wheel assembly and extending forwardly therefrom and having a rear portion rearwardly of the wheel assembly, a trailer tow bar unit connected to the forward end of the front portion and extended forwardly therefrom, first and second elongated rear stabilizing legs pivotally connected one each to each side of the frame adjacent the rear portion of the frame, each of said legs being pivotally secured to the frame, each of said legs having a hydraulic cylinder power unit connected to the frame and to the leg and operable to raise the leg to a substantially vertical transport position and extendable to lower the leg to a ground engaging stabilizing position, said power unit being pivotally connected to the frame above the pivot connection of the leg to the frame and generally in the plane of the force application of the boom assembly to the frame to thereby minimize the tilting forces applied to the frame leg structure by the boom assembly, a forward stabilizing leg located centrally of the frame and including a substantial curved plate member having a bottom edge, said plate member digging into the ground and curved forwardly to create a vertical and horizontal holding force in the digging position, said front stabilizing leg located centrally between the rear stabilizing legs, a hydraulic cylinder power unit connected to the frame and to said forward stabilizing leg for raising and lowering said plate member, and an articulated boom assembly secured to said frame forwardly of the wheel assembly, a bucket pivotally secured to said boom assembly, hydraulic cylinder power units connected to said bucket and said arm assembly for digging operation, a hydraulic pressurized supply system mounted to the front of said frame, an operator station including individual controls connecting said supply system to said hydraulic cylinder power units, said frame and components to the front of said wheel assembly establishing a vertical force forwardly of the wheel assembly essentially equal to the vertical force created by the bucket and boom assembly and rear stabilizing legs rearwardly of the wheel assembly whereby the apparatus is substantially balanced about the single axle, and said three-point support defined by said three stabilizing legs minimizing the tipping force on the frame as a result of the digging forces.

11. The apparatus of claim 10 wherein said supply system includes a gasoline driven high efficiency industrial-type pump secured to the front of said frame and connected to the hydraulic cylinder power units, and a reservoir secured to the front of said frame.

12. A self-contained trailerable back-hoe apparatus adapted for direct over-the-road trailering by an automobile-type vehicle, comprising:

a support frame having a front trailering hitch means, a wheel assembly affixed to the frame and including back wheel means including laterally spaced rotating back wheels having an axis extending transversely of the front to back of the frame and adapted to support the back-hoe for over-the-road trailering at normal over-the-road speeds, said wheel assembly including laterally spaced front wheel means secured to the support frame forwardly of said rotating back wheels to support the frame with the frame detached from the vehicle, a digging stabilizing means connected to said frame and including rear and front ground engaging stabilizers connected to the frame and power means for moving the stabilizers to the ground, a vertical pivot support secured to said frame rearwardly of said wheel assembly, an articulated back-hoe digging arm assembly rotatably mounted on said vertical pivot support, a bucket secured to the outer end of said arm assembly, said arm assembly having a position to establish a balanced loading on the frame about said laterally spaced back wheels to permit convenient moving of the apparatus on-site, power means connected to said arm assembly for pivoting said arm assembly about said vertical support, said arm assembly including a plurality of articulated arm members adapted to be selectively extended and contracted and to selectively place said bucket in ground engagement for digging with said three point stabilizing means in ground engagement and for moving the apparatus with said frame supported by said back wheels and said front wheel means of said wheel assembly, said apparatus being movable substantially directly perpendicular to the front to back of said frame by manipulation of said arm assembly and bucket with selective engagement of the bucket with the ground and by rotating said arm assembly about said vertical pivot support, and bucket control powered means connected to said frame and to said arm assembly and connected to said arm members for positioning said bucket and said arm assembly and said arm members.

* * * * *

US004925358B1

REEXAMINATION CERTIFICATE (2808th)

United States Patent [19] [11] B1 4,925,358

Cook [45] Certificate Issued Mar. 5, 1996

[54] TRAILERABLE EARTH DIGGING APPARATUS

[75] Inventor: Paul J. Cook, New Berlin, Wis.

[73] Assignee: HCC Inc., Mendota, Ill.

Reexamination Request:
No. 90/003,717, Feb. 1, 1995

Reexamination Certificate for:

| | |
|---|---|
| Patent No.: | **4,925,358** |
| Issued: | **May 15, 1990** |
| Appl. No.: | **122,544** |
| Filed: | **Nov. 12, 1987** |

[21] Appl. No.: 122,544

Related U.S. Application Data

[63] Continuation of Ser. No. 931,921, Nov. 14, 1986, abandoned, which is a continuation of Ser. No. 610,349, May 15, 1984, abandoned.

[51] Int. Cl.[6] ..... E02F 3/00

[52] U.S. Cl. ..... 414/685; 414/690; 414/694

[56] References Cited

U.S. PATENT DOCUMENTS

| | | |
|---|---|---|
| 3,101,854 | 8/1963 | Kampert . |
| 3,362,548 | 1/1968 | Cunningham . |
| 3,777,919 | 12/1973 | Konijn . |
| 3,850,473 | 11/1974 | Huber . |
| 4,142,642 | 3/1979 | Myers . |
| 4,408,949 | 10/1983 | Witty . |

FOREIGN PATENT DOCUMENTS

| | | |
|---|---|---|
| 2083932 | 12/1971 | France . |
| 1337062 | 11/1973 | United Kingdom . |

OTHER PUBLICATIONS

Davis Golden Dipper, Model A Backhoe Owner's Manual, Davis Mfg. Inc., 1500 S. McLean Blvd.; Wichita, Kans.; 20 pages; 1968.

*Primary Examiner*—Karen B. Merritt

[57] ABSTRACT

A small, self-contained portable back-hoe has a wheeled frame with a towing tongue for over-the-road trailering. Pivoted outriggers are connected to the back and a third support is secured to the front of the frame. Cylinder units are coupled to position the supports for digging and in raised position for trailering. The bucket and articulated boom assembly is affixed to the frame with a vertical pivot and includes cylinder units for digging operation thereof. An operator station and a hydraulic power supply source or system is secured to the front of the frame. A special hydraulic supply is integrated into the front framework. The back-hoe boom assembly and operating assembly are balanced about the single axle for convenient positioning. The bucket assembly and three-point support are arranged to minimize the tipping of the frame as a result of the digging forces. A gasoline driven high efficiency industrial-type pump is connected to the cylinder units with a filter and the suction side. A reservoir is built into the front frame structure and includes a watertower element to eliminate air from the hydraulic liquid. The reservoir reliably removes the air from the liquid to avoid pump malfunction.

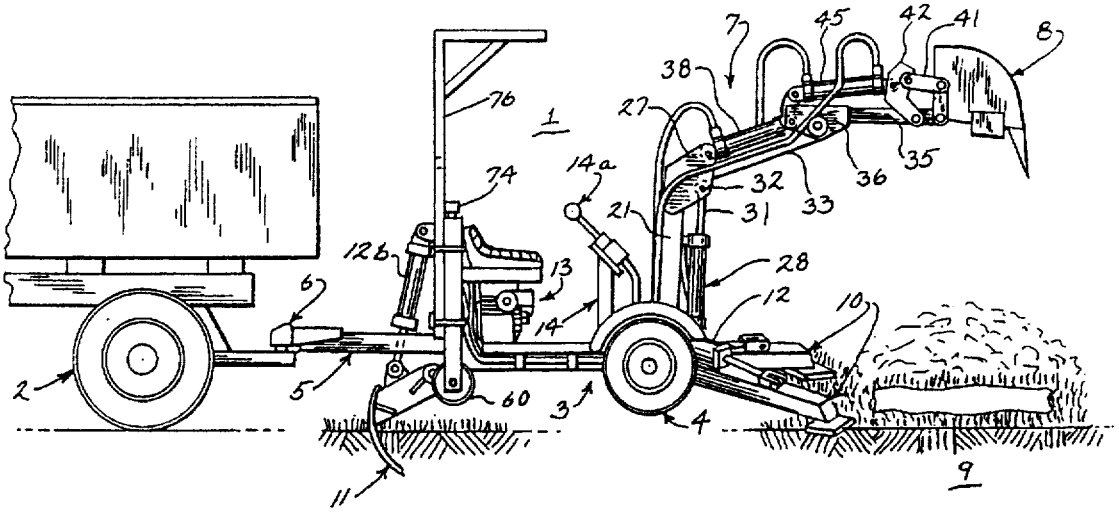

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–12 is confirmed.

* * * * *